United States Patent [19]

Höfer et al.

[11] Patent Number: 4,924,833

[45] Date of Patent: May 15, 1990

[54] FUEL-INJECTION PUMP FOR AN INTERNAL-COMBUSTION ENGINE

[75] Inventors: Gerald Höfer, Bad Aibling, Fed. Rep. of Germany; Franz Eheim, deceased, late of Stuttgart, by Helga Eheim, legal representative, Fed. Rep. of Germany

[73] Assignee: Robert Bosch GmbH, Stuttgart, Fed. Rep. of Germany

[21] Appl. No.: 243,300

[22] PCT Filed: Dec. 4, 1987

[86] PCT No.: PCT/DE87/00570

§ 371 Date: Aug. 22, 1988

§ 102(e) Date: Aug. 22, 1988

[87] PCT Pub. No.: WO88/05128

PCT Pub. Date: Jul. 14, 1988

[30] Foreign Application Priority Data

Dec. 27, 1986 [DE] Fed. Rep. of Germany ..... 3644583

[51] Int. Cl.[5] ..... F02M 39/00

[52] U.S. Cl. ..... 123/449; 123/503

[58] Field of Search ..... 123/449, 503, 373, 506; 417/254, 268, 500, 492

[56] References Cited

U.S. PATENT DOCUMENTS

| | | | |
|---|---|---|---|
| 4,662,336 | 5/1987 | Hofer | 123/449 |
| 4,714,412 | 12/1987 | Bohringer | 123/503 |
| 4,718,385 | 1/1988 | Konrath | 123/449 |
| 4,741,314 | 5/1988 | Hofer | 123/449 |
| 4,763,631 | 8/1988 | Fehlmann | 123/503 |

FOREIGN PATENT DOCUMENTS

| | | | |
|---|---|---|---|
| 3203582 | 8/1983 | Fed. Rep. of Germany | 123/449 |
| 3429128 | 2/1986 | Fed. Rep. of Germany | 123/449 |
| 3510221 | 9/1986 | Fed. Rep. of Germany | 123/449 |
| 0102423 | 8/1979 | Japan | 123/449 |
| 488423 | 1/1976 | U.S.S.R. | 123/449 |

*Primary Examiner*—Carl Stuart Miller

*Attorney, Agent, or Firm*—Michael J. Striker

[57] ABSTRACT

A fuel-injection pump comprises a pump cylinder, a pump plunger formed with a first relief duct opening into a working space and also opening radially at a first outlet opening into a relief space, and a drive for periodically rotating and axially reciprocating the plunger. An annular slide on the plunger can cover the first outlet opening so that a speed controller can axially shift the slide and thereby vary the venting of the working space into the relief space. An annular groove formed in the cylinder opens inward toward the plunger and a second outlet opening from the first relief duct also opens at the groove. A second relief duct formed in the plunger and opening at a respective second outlet opens at the groove and the second outlet openings are relatively spaced such that during a partial stroke of the pump plunger they communicate with each other via the groove. A first outlet opening of the second relief duct opens in the relief space generally at the slide and a control opening formed in the slide and opening into the relief space is alignable with the first outlet opening of the second duct. An interrupting device connected mechanically with an external load-controlling means, e.g. the accelerator, in a first operating state connects the first outlet opening of the second duct with the relief space via the control opening and in a second operation state disconnects that connection.

19 Claims, 6 Drawing Sheets

FUEL-INJECTION PUMP FOR AN INTERNAL-COMBUSTION ENGINE

FIELD OF THE INVENTION

The present invention relates to a fuel-injection pump for an internal-combustion engine. More particularly this invention concerns such a pump having a separate so-called "soft" operation phase.

BACKGROUND OF THE INVENTION

A standard fuel-injection pump comprises a pump cylinder, a pump plunger subdividing the cylinder into a pump working chamber or space and a relief chamber or space and formed with a first relief passage or duct opening into the working space and also opening radially at a first outlet opening into the relief space, and formations on the plunger for periodically feeding fuel to the working space and a speed-responsive cam-type drive for periodically rotating and axially reciprocating the plunger. An annular side is displaceable in the relief space on the plunger over the first outlet opening so that a speed controller and governor can axially shift the slide and thereby vary the venting of the working space via the relief duct into the relief space.

In a fuel injection pump of this type, which is known from DE-OS 32 03 582, the first outlet opening of the first relief duct is controlled by means of an internal annular groove at the internal cylinder of the annular slide, which internal annular groove serves as a control opening, wherein the internal annular groove is constantly connected with the relief space via a duct. In addition, the first outlet opening of the second relief duct is controlled by means of the grooves proceeding from the end face of the annular slide on the pump working space side, which grooves are arranged in such a way and in such quantities that one of the grooves lies in the stroke direction of the first outlet opening of the second relief duct during every second delivery stroke of the pump plunger. However, this results in a relieving of the working space via the first relief duct, the annular groove and the second relief duct only so long as a connection is made between the first and second relief ducts and the first outlet opening simultaneously opens into one of the grooves. This is the case in the known fuel injection pump in the idling position of the annular slide. If the annular slide is displaced in the direction of higher load, the second outlet opening of the second relief duct is already closed before the first outlet opening is opened. In the known fuel injection pump, a load-dependent switching off of the injection is accordingly obtained in a portion of the delivery strokes of the pump plunger. In this way, a partial stopping of the cylinders of the internal combustion engine is achieved during low-load operation and the consumption of the internal combustion engine is optimized in that the cylinders which are not switched off are operated with relatively high load and accordingly a higher efficiency.

On the other hand, a fuel injection pump with a soft-running device is known from DE-OS 32 18 275 in which only one relief line leads from the pump working space, the single outlet opening of the relief line at the pump plunger surface within the relief space being likewise controlled by means of an annular slide. The annular slide likewise comprises grooves proceeding from its end face, which grooves have a slot-shaped throttling cross section relative to the outer surface range of the internal cylinder of the annular slide. During the delivery stroke of the pump plunger and a corresponding rotational position of the annular slide, the connection between the outlet opening and the relief space is produced first via these grooves and only then via the control edge formed by the internal bore hole and end face of the annular slide. Accordingly, in the by-pass for the fuel injection quantity delivered to the injection nozzles, a partial quantity is diverted from the total feed rate of the pump plunger as a leakage quantity, which enables a soft running of the internal combustion engine by means of an injection rate which is accordingly reduced. By means of a rotating device, which works by means of a fuel injection quantity governor irrespective of the adjustment of the annular slide, the effectiveness of the throttling grooves and the soft-running device, respectively, can be switched off.

However in this known fuel injection pump problems arise with respect to the control of the fuel quantity flowing off via the throttle cross section. In particular, problems exist in continuously increasing the fuel quantity from the transition from the idling area into the partial-load area so that no load jump occurs when load is received. In addition, problems arise when an arrangement for adjusting the start of injection, which usually consists in that the first outlet opening is adjusted relative to the rotational position of the drive shaft of the fuel injection pump, is assigned to the fuel injection pump.

OBJECTS OF THE INVENTION

It is therefore an object of the present invention to provide an improved fuel-injection pump.

SUMMARY OF THE INVENTION

These objects are achieved according to this invention in a pump of the above described general type which is provided with an annular groove formed in the cylinder opening inward toward the piston or plunger, a second outlet opening from the first relief duct opening on the plunger at the groove, and a second relief passage or duct formed in the plunger and opening at a respective second outlet opening radially at the groove. The second outlet openings are axially relatively spaced such that during a predetermined partial delivery stroke of the pump plunger they communicate with each other via the groove. A first outlet opening of the second relief duct opens in the relief space generally at the slide and a control opening formed in the slide opens into the relief space, and is alignable with the first outlet opening of the second duct. An interrupting unit is connected to the slide for displacing same between a position corresponding to a first operating state in which the second outlet opening of the second duct is connected with the relief space via the control opening and a position corresponding to a second operating state in which the second outlet opening of the second duct does not open via the control opening into the relief space.

This is system has the advantage of a soft-running system that is realized in which a determined partial stroke, which can be modified additionally in a load-dependent manner, effects a leakage or an injection with reduced injection rate, respectively, wherein, independently of the latter, the soft-running device can be switched off without jerks, preferably as a function of operating parameters of the internal combustion engine. Thus, the full delivery capacity of the fuel injection pump is available in full-load operation. The switching off can also be effected in a transition without jerks, preferably as a function of the load. This function is in no way influenced by an arrangement for adjusting the start of injection, since the control openings are already wide enough to cover the entire adjusting area of the start of injection.

Advantageous developments and improvements of the fuel injection pump indicated are made possible by means of the features indicated in the subclaims. As a result of a feature of this invention whereby the second passage is closed a short time after the start of each injection, there is the advantage that a constant preloading stroke of the pump plunger is always available before the commencement of the feed effectiveness of the pump plunger and before the start of leakage, so that fluctuations of the fuel injection quantity due to the dead volume influence are avoided to a great extent. A reliable switching off of the soft-running device is obtained by means of the adjusting arrangement of this invention wherein the control opening is an axial or longitudinally extending groove opening at the pump side of the plunger, and in the system wherein the control opening is a passage extending through the slide to the relief compartment or sump, the switching off is effected in a simple fashion in a load-dependent manner by means of the stroke movement of the annular slide without the need of an additional lever, and an additional influencing of the range of effectiveness of the soft-running device i.e. of the leakage, can be effected via the throttle cross section by means of the adjusting element.

DESCRIPTION OF THE DRAWING

The above and other objects, features, and advantages will become more readily apparent from the following, reference being made to the accompanying drawing in which.

SPECIFIC DESCRIPTION

Figure 1:
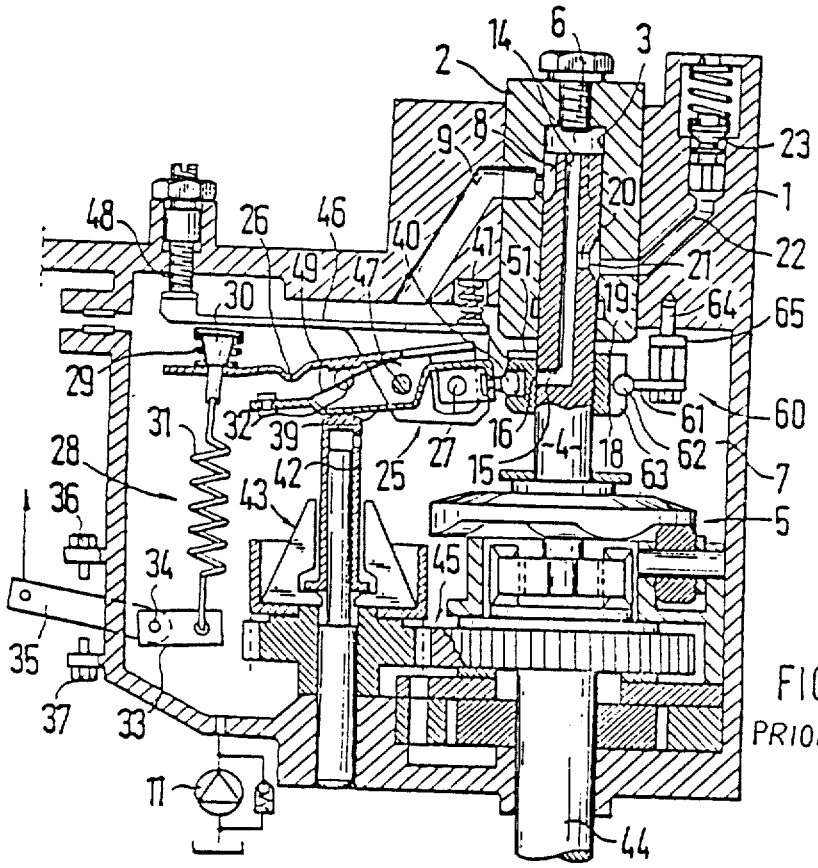
FIG. 1 PRIOR ART
FIG. 1 is a section through a fuel pump of the type of the instant invention.

As seen in FIG. 1 a sleeve or bush 2 is arranged in a housing 1 of a fuel injection pump shown in FIG. 1; a pump plunger 4, which is driven by means of a cam drive 5, executes a reciprocating and simultaneously rotating movement in a bore hole 3 of the bush 2, which bore hole 3 forms a pump cylinder 3. The pump plunger encloses a pump working space 6 on one of its front sides and partially projects out of the pump cylinder 3 into a pump suction space 7 which forms a relief space and is enclosed in the housing 1.

Via longitudinal grooves 8, which are arranged in the outer surface area of the pump plunger, and a suction bore hole 9, which passes through the bush 2 radially and extends in the housing 1 and proceeds from the pump suction space 7, the pump working space 6 is supplied with fuel as long as the pump plunger is in its suction stroke or its bottom dead center position. The pump suction space is supplied with fuel from a fuel reservoir via a delivery pump 11. The pressure is controlled as a function of speed, usually in the suction space, by means of a pressure control valve, e.g. in order to be able to carry out an injection adjustment as a function of speed hydraulically by means of a pressure which is controlled as a function of speed. In so doing, the commencement of stroke of the pump plunger is adjusted in advance, in a known manner, as the speed increases.

In the pump plunger, a longitudinal duct in the form of a blind bore hole leads from the pump working space 6 and is designated as relief duct 14. A transverse bore 15 branches off from the latter and leads to a first outlet opening 16 at the outer surface of the pump plunger 4, into an area in which the latter projects into the suction space 7. In this area, a quantity adjustment member is arranged on the pump plunger in the form of an annular slide 18 which slides on the pump plunger with the surface area 17 of its internal cylinder in a tight manner, is rotatable and displaceable and controls the first outlet opening 16 with a first control edge 19 which is formed by means of the surface 17 and its upper front side.

In addition, a radial bore 20 branches off from the relief duct 14 and leads to a distributor opening 21 at the pump plunger surface. In the working area of this distributor opening, delivery lines 22 branch off from the pump cylinder 3 in a radial plane, which delivery lines 22 are arranged so as to be distributed at the circumference of the pump cylinder 3 corresponding to the quantity of cylinders of the respective internal combustion engine which are to be supplied with fuel. The delivery each lead to the fuel injection points, not shown, via a valve 23, in each instance, which is designed in a known manner as a check valve or as a pressure relief valve. As soon as the suction bore 9 is closed by means of the outer surface area of the pump plunger at the start of the delivery stroke of the pump plunger after a corresponding rotation of same, the fuel located in the pump working space 6 is delivered to these fuel injection points via the relief duct 14, the radial bore 20 and the distributor groove 21. This delivery is interrupted when the first outlet opening 16 is opened by means of the annular slide and communicates with the suction space 7 during the course of the piston plunger stroke After this point, the remaining fuel displaced by the pump plunger is now only delivered to the suction space The higher the adjustment of the annular slide 18 toward the pump working space, the greater the fuel injection quantity delivered by the pump plunger.

The fuel injection quantity governor 25 provided for the adjustment of the annular slide comprises a tensioning lever 26 which is constructed so as to have one arm and so as to be swivelable around an axle 27, the tensioning lever 26 being coupled with a governing spring arrangement 28 at its lever arm end, by means of which governing spring arrangement 28 it is swivelable toward a full-load stop 32. The latter comprises an idling spring 29 which is arranged between the head of a coupling member 30 and the tensioning lever, wherein the coupling member 30 is inserted through an opening in the tensioning lever and connected with a main governing spring 31 at the other end remote from the head. This main governing spring 31 is in turn hinged at a swivel arm 33 with its other end, which swivel arm 33 is adjustable with an adjusting lever 35 by means of a shaft 34 guided through the pump housing. The adjusting lever can be actuated as desired by an operator between an adjustable full-load stop 36 and an adjustable idling stop 37. For example, the adjusting lever 35 is connected with the accelerator, which is actuated, according to the desired torque, by the driver of the motor vehicle equipped with the internal combustion engine and the injection pump. Of course, other governing spring arrangements, which are constructed so as to comprise multiple steps and/or so as to be pre-loaded, can also be used as a main governing spring in place of the simple coil spring shown here.

A starting lever 39 is swivelable around the axle 27, in addition, the starting lever 39 is constructed so as to have two arms and is coupled with the annular slide with one arm engaging via a ball head 40 in a transverse groove 41 which extends in a radial plane relative to the annular slide. The other arm of the starting lever comprises a leaf spring 49 which is supported as a starting spring against the tensioning lever 26 so as to bear on the latter. The actuating element 42 of a speed transmitter in the form of a centrifugal adjusting arrangement 43 of a known type acts precisely on this lever arm of the starting lever 39. This centrifugal adjusting arrangement 43 is driven synchronously with the drive shaft 44 of the fuel injection pump by means of a toothed gear unit 45. Thus, after starting, the actuating element 42 is displaced together with the starting lever 39 and the annular slide 18 against the force of the starting spring 49 as the speed increases until the starting lever comes to rest at the tensioning lever 26 contacting the full-load stop 32. In the course of this movement, the annular slide is adjusted from a highest position closest to the pump working space which corresponds to a starting quantity adjustment, toward the pump plunger drive side and, in so doing, the excess starting quantity is controlled down. When the starting lever comes to rest at the tensioning lever, the two levers are swiveled away from the full-load stop 32 against the force of the idling spring 29 as the speed increases until the main governing spring 31 subsequently takes effect at the idling area. Depending on the design of this spring as an all-speed governing spring or an idling speed governing spring, the tensioning lever is moved further when the adjusted speed is reached, and the annular slide 18 is displaced in order to reduce the injection quantity. Thus, depending on the position of the adjusting lever 35, a larger or smaller fuel injection quantity is injected at a determined speed.

For the purpose of adjustment, the axle 27 is supported on an adjusting lever 46 which is swivelable around an axle 47, which is fixed with respect to the housing, and is held in contact with an adjustable stop 48 by means of a spring.

Figure 2:
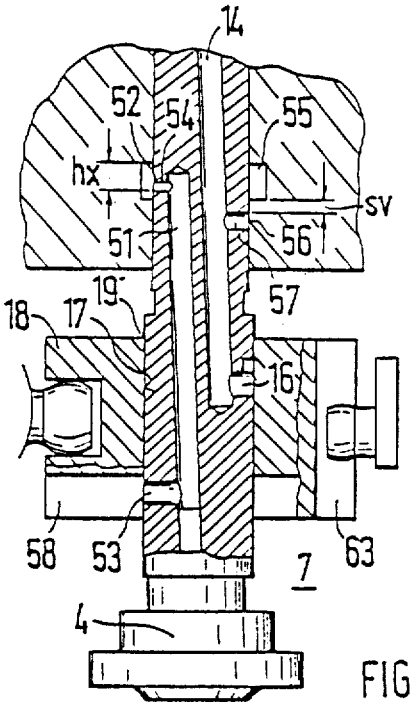
FIGS. 2 and 3 are detail views of first and second embodiments of the invention.

As described thus far, the fuel injection pump corresponds to a known design. FIG. 2 shows the further development, according to the invention, for a first embodiment of the invention which comprises the following: in addition to the relief duct 14, which is designated in the following as first relief duct, a second relief duct 51 is provided in the pump plunger which, alongside the first relief duct, leads from a second outlet opening 52 at the surface of the pump plunger within the pump cylinder 3 to a first outlet opening 53 at the skirt of the pump plunger in the area of the annular slide 18, which is displaceable on the pump plunger. The second outlet opening is connected via a throttle bore 54 with the second relief duct 51 which is produced from a blind bore. The second outlet opening 52 opens into the area of an annular groove 55 which is provided at the wall of the pump cylinder 3, a second outlet opening 56 of the first relief duct 14 also communicating with the annular groove 14 in the course of the pump plunger stroke. This second outlet opening 56 is formed by means of radial duct 57 which branches off from the first relief duct 14. The second outlet openings 52 and 56 are assigned to the annular groove 55 in such a way that the second outlet opening 52 of the second relief duct already communicates with the annular groove 55 in the bottom dead center position of the pump plunger at the start of its delivery stroke, but is closed again by means of the wall of the pump cylinder 3 after a stroke hx. The second outlet opening 56 of the first relief duct communicates with the annular groove 55 only after a stroke sv which is smaller than the stroke hx. By means of this stroke, fuel is delivered by the pump plunger when the first outlet opening 16 is closed by means of the annular slide, but this fuel only serves for the compression of the fuel in the pump working space 6 and in the subsequent connection to the respective controlled injection nozzle until a high pressure occurs which is close to or equal to the opening pressure of the injection valve. After the initial stroke sv, a high-pressure injection can be effected.

Figure 6:
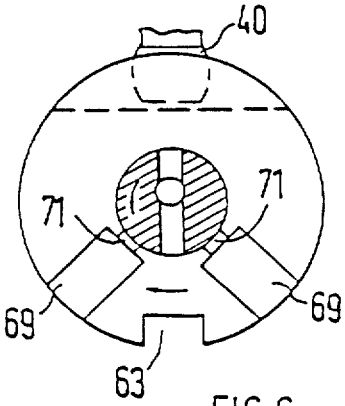

After the production of the connection of the second outlet opening 56 with the annular groove 55, however, fuel can flow off via the annular groove 55, the second outlet opening 52, the second relief duct 51 and its first outlet opening 53, insofar as the latter is opened. In the position of the annular slide shown in FIG. 2, the latter opens into a control opening which is provided at the annular slide in the form of a groove 58 which is cut into the annular slide proceeding from the front side of the latter on the pump drive side. In this case, fuel can flow off in a throttled manner via the throttle bore 54 parallel to the delivery into the respective pressure line 22, which reduces the injection-effective feed rate of the pump plunger. A desired feed rate which causes a soft combustion behavior in the cylinders of the internal combustion engine can be achieved by means of the dimensioning of the throttle. The maximum duration of this "leakage" via the second relief duct 51 is determined by means of the stroke length hx - sv. After this, the second outlet opening 52 is closed and the pump plunger delivers at the feed rate provided according to its design. This delivery stroke is terminated when the first outlet opening 16 of the first relief duct 14 is opened by means of the first control edge 19 formed between the outer surface area 17 of the internal cylinder of the annular slide 18 and its front side on the pump working space side. The further the annular slide 18 is displaced toward the pump working space by means of the fuel injection quantity governor, the greater this stroke. Grooves, such as the groove 58, are arranged so as to be distributed at the annular slide, specifically when only a first outlet opening 53 of the second relief duct is provided, in the same quantity and rotational angle distribution as the delivery strokes executed by the pump plunger per revolution. At the start of the stroke of the pump plunger, the first outlet opening 53 already communicates with one of the grooves 58 in the idling area. If the internal combustion engine is provided for supplying an even number of cylinders of an internal combustion engine, two diametrically opposed outlet openings 53, instead of one, can be provided. The number of grooves 58 is then halved and they are then located in a simple rotational angle distance from one another, as shown e.g. in FIG. 6. The distance amounts to 90 degrees when supplying a four-cylinder internal combustion engine.

In addition, the soft-running device described above is constructed in such a way that it can be turned off. For this purpose, the annular slide 18 must be rotated far enough so that the second outlet opening 53 of the second relief duct 51 is completely closed at the start of the stroke of the pump plunger or, at the latest, after running through the initial stroke sv, and also remains closed in the course of the subsequent pump plunger delivery stroke. For this purpose, the annular slide 18 is provided with a rotating device 60 which comprises an angle lever 61, a ball head 62 fitting at one lever arm of the latter and engaging in a longitudinal groove 63 at the annular slide as a sliding part. This longitudinal groove is located, e.g. as shown in FIG. 2, diametrically opposite the ball head 40 and extends in the longitudinal direction relative to the pump plunger axis. The angle lever 61 is supported on an axle 64 which is anchored so as to be fixed with respect to the housing, the end of the other lever arm 65 of the angle lever, which lever arm 65 is bent in a U-shaped manner, being arranged on this axle 64 so as to be swivelable. The other lever arm, which is bent in a U-shaped manner, is coupled with the adjusting lever 35 by means of a transmission arrangement, not shown, containing a free-wheel, and can be moved synchronously with the latter. In so doing, an adjustment of the annular slide is effected in the direction of rotation at the start of the swiveling out movement of the adjusting lever 35 from its idling stop until the rotational position of the annular slide has reached an end position in a partial position of the adjusting lever 35. During the continued movement of the adjusting lever, this movement is intercepted by means of the provided free-wheel. In the rotated position of the annular slide 18, the grooves 58 are offset far enough so that the second outlet opening 53 of the second relief duct no longer communicates with one of these grooves, and the complete, original pump plunger stroke is available for delivery of the injection quantity.

Figure 4:
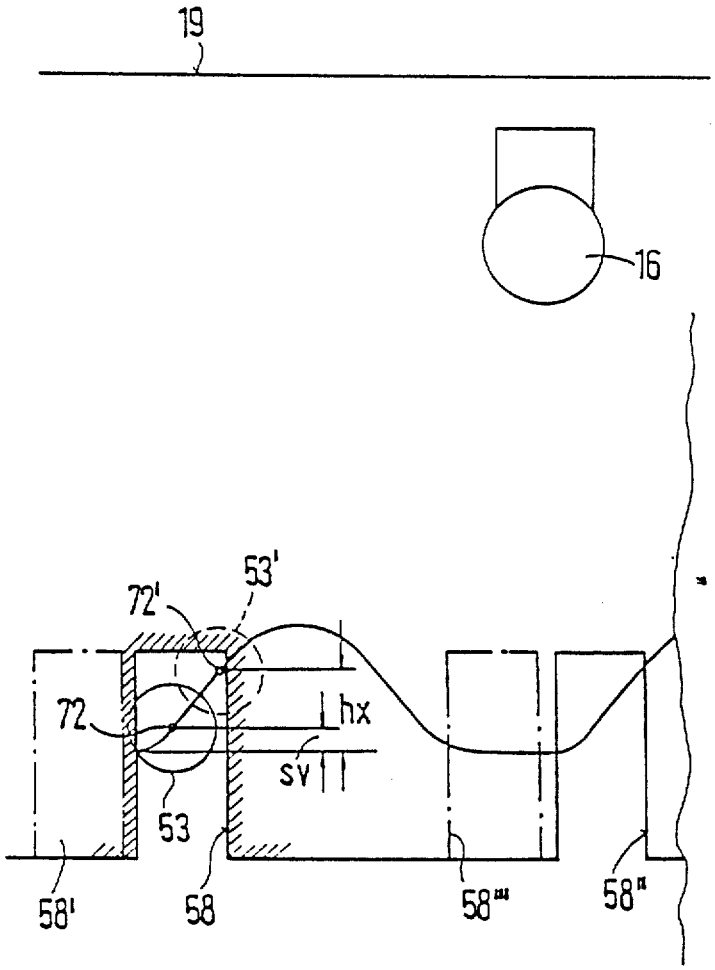
FIG. 4 diagrammatic developed view illustrating operation of the system of this invention.

FIG. 4 shows a developed view of the plunger skirt and the outer surface area 17 of the internal cylinder of the annular slide. This developed view shows the positions, respectively, of the control opening, the cross sections of the grooves 58, the first outlet opening 53 and the first outlet opening 16 at a rotational angle spacing of 90 degrees. In addition, a pump plunger curve is shown, along which the first outlet opening 53 of the second relief duct 51 moves with respect to the control opening 58. In addition, the position of the control opening after the annular slide has been rotated for the purpose of switching off is shown in dot-dash lines.

Figure 3:
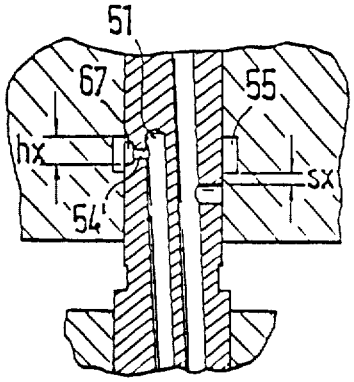

FIG. 3 shows a variant of the embodiment according to FIG. 2, in which a recess 67 is provided as second outlet opening 52 of the second relief duct 51, which recess 67 is connected with the second relief duct 51 via a throttle bore 54'. The recess preferably has defining edges parallel to the defining edges of the annular groove 55. This construction allows a more exact adjustment of the stroke, after which the connection between the second relief duct 51 and the first relief duct 14 is effectively interrupted. Instead of the arrangement of the throttle at the place, provided in FIGS. 2 and 3, between the second outlet opening 52 and its connection with the second relief duct 51, the throttle can also be provided at another place. For example, a throttle bore hole can be provided between the first outlet opening 53 and the second relief duct 51 for this purpose, or the throttle can be connected in the connection between the second outlet opening 56 of the first relief duct and the latter. The solutions shown in FIGS. 2 and 3 and the solution mentioned above have the advantage that the volume of the high-pressure portion, and accordingly also the harmful dead volume, is smaller upstream of the throttle.

Figure 5:
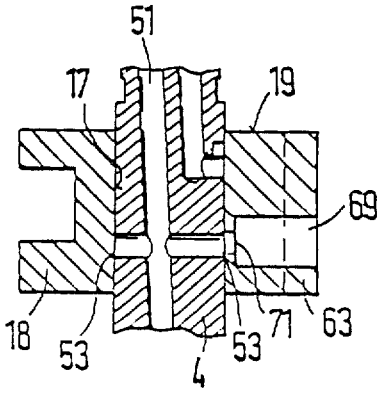
FIGS. 5 and 6 are axial and cross sections through a third embodiment of the invention.

Instead of the grooves 58 proceeding from the pump drive side, according to the embodiment example according to FIG. 2, it is possible in a modification of the latter, according to the construction according to FIG. 5, to construct the control opening as a window-shaped opening inside the outer surface area 17 of the internal cylinder of the annular slide. In the section through a portion of the pump plunger and the annular slide, shown in FIG. 5, this portion comprises a radial duct 69 whose inlet into the outer surface area 17 of the annular slide is constructed as a four-sided window 71 with defining edges which ar parallel to the first control edge 19. This window acts in an analogous way to the groove 58. The second relief duct 51 is also preferably provided in this case with two first outlet openings 53, to which are allotted only half of the control openings or windows 71 that would be necessary if only one second outlet opening 53 were provided. Accordingly, two radial ducts 69, comprising one window 71 in each instance, are provided in a distributor injection pump, which serves to supply four cylinders of an internal combustion engine, so as to be symmetrical to the axis formed by means of the longitudinal groove 63 and the point of application of the ball head 40. This arrangement is seen from the section in FIG. 6. Moreover, the same applies as was stated with respect to FIGS. 2 and 3. Throttles can also be provided in particular in the connection between the first outlet openings 53 and the second relief duct 51.

Figure 7:
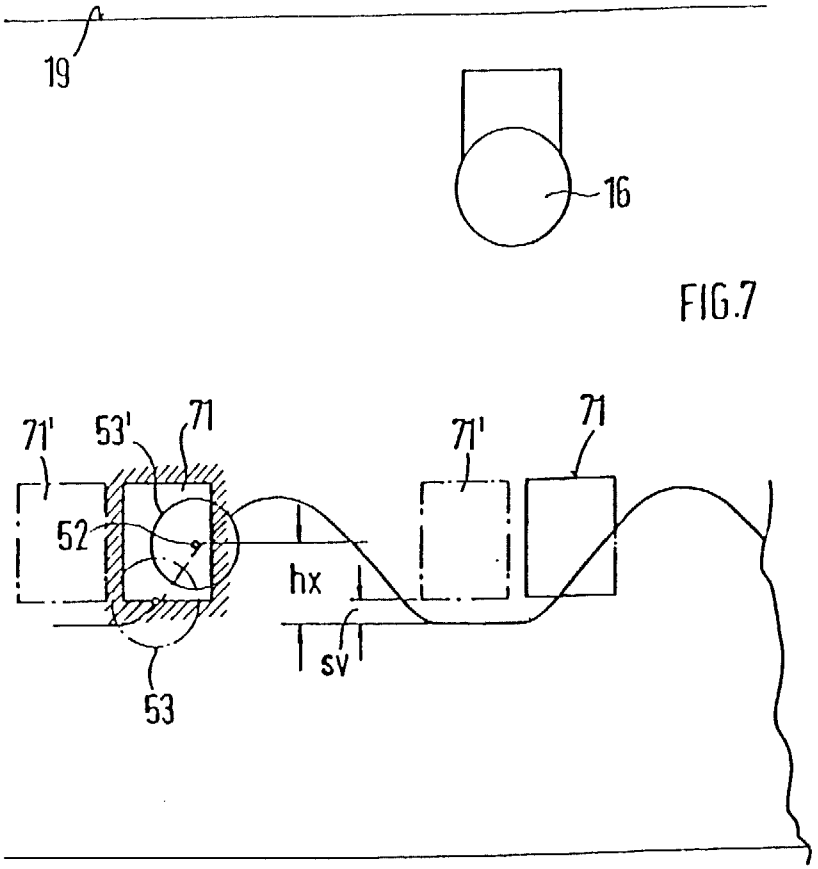
FIG. 7 is a developed view illustrating the system of FIGS. 5 and 6.

FIG. 7 shows the developed view of the outer surface area 17 of the internal cylinder of the annular slide 18 for the embodiment according to FIG. 5 in a manner analogous to FIG. 4. A pump plunger curve which follows the first outlet opening 53 of the second relief duct 51 is also shown here. Vafious positions of the first outlet opening 53' are shown as well a the switching-off position of the annular slide with the window 71'. As in FIG. 4, it can also be seen here that the width of the window 71 and the groove 58, respectively, allows a variation of the injection adjustment without influencing the functioning of the soft running. The diagram shows a throttle bore 72 as a concentrically smaller circle relative to the outer circumference of the first outlet opening 53, the throttle bore 72 replaces the throttle bore 54 as provided in FIG. 2. The switching off of the soft-running device is effected here in the same manner as described above.

Figure 8:
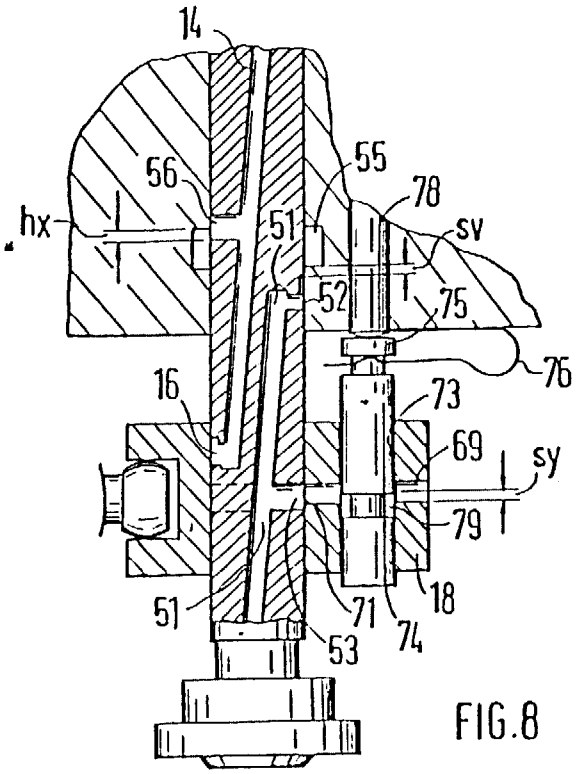
FIG. 8 is an axial section through a detail of a fourth embodiment of the invention.

However, in a fourth embodiment, according to FIG. 8, the switching off is effected in a different way. Proceeding from the embodiment according to FIG. 5, which comprises as control opening one or more windows 71 connected with a duct 69 which penetrates the annular slide radially and opens into the suction space 7, the annular slide in this instance is not constructed so as to be rotatable. Instead, a bore 73 is provided in the annular slide, which bore 73 lies parallel to the axis of the internal cylinder of the annular slide 18 and completely intersects the radial duct 69. A slide pin 74 is arranged in this bore so as to be displaceable in a tight manner and comprises a head 75 at its projecting end on the pump working space side, which head 75 engages behind a coupling spring 76 and holds the latter in contact with an adjusting member 78. The latter is a pin which is guided through the pump housing so as to be parallel to the pump cylinder 3 and can be actuated by means of an adjusting device. This pin stands still so as to be adjusted substantially in a fixed manner, so that the slide pin 74 is displaced in the bore 73 during an axial adjustment of the annular slide 18. In order to control the passage of the radial duct 69, the slide pin 74 in this example comprises an annular groove 79 which is closed by means of the wall of the bore 73 after a determined stroke adjustment of the annular slide 18 out of its idling position. Accordingly, the radial duct 69 is also closed and a leakage of fuel via the second relief duct 51 is prevented, as described above. Thus, a load-dependent switching off of the soft-running device results here, as well, wherein the free displaceability of the slide pin 74 replaces the free-wheel necessary in the preceding embodiment examples. Moreover, by means of the adjustment possibility of the adjusting member 78, an exact adjustment results, as well as the possibility of changing this adjustment as a function of determined operating values. These would be parameters which particularly influence the soft running of the internal combustion engine or which are dependent thereon. Since only one control opening can be realized at reasonable cost in this case, first outlet openings 52 are provided at the pump plunger corresponding to the number of pump strokes of the pump plunger per revolution.

Figure 9:
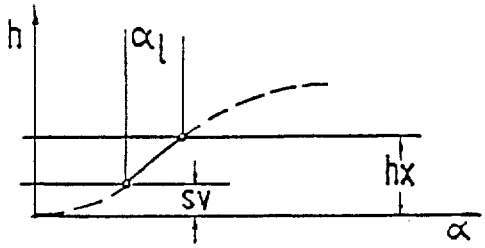
FIGS. 9 and 10 are graphs illustrating operation of the system of FIG. 8.
Figure 10:
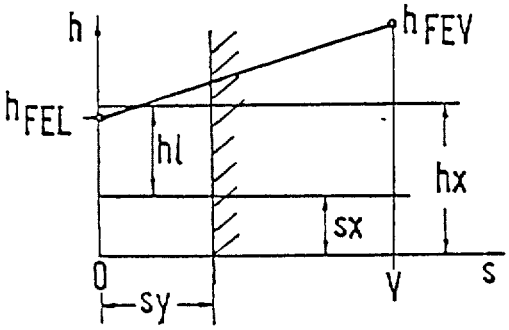

With respect to the operation of the embodiment according to FIG. 8, FIG. 9 shows the pump plunger stroke along the angle of rotation. As in the preceding embodiment examples, the connection between the pump working space and the first outlet opening 53 of the second relief duct 51 is produced only after an initial stroke sv. In this case, it is the second outlet opening 52 of the second relief duct 51 which is first closed by means of the wall of the pump cylinder 3 at the start of the stroke of the pump plunger. The second outlet opening 56 of the first relief duct 14, on the other hand, already communicates with the annular groove 55 from the start and is closed after a stroke hx. The construction shown here is equivalent to the construction in the embodiment example according to FIG. 2 in this respect. The total stroke of the pump plunger hx, by way of which the pump working space communicates with the annular groove 55, is now drawn in FIG. 9. The difference between the strokes hx and sv is the distance of the leakage or the reduced fuel injection rate hl. The diagram in FIG. 10 refers to the special construction according to FIG. 8 and the design of the switching off, specifically as a diagram of the plunger stroke load. In this diagram, the annular slide position in which a switching off of the soft-running device occurs is adjusted by sy. In addition, the pre-loading stroke sv is drawn in as a line parallel to the abscissa, and the stroke hx, in which a leakage is prevented via the annular groove 55, is drawn parallel to this. In addition, the stroke, in which the high-pressure delivery of the pump plunger is basically terminated by means of opening the first outlet opening 16 of the first relief duct, is plotted as a diagonal straight line increasing from no-load to full load. The greatest possible stroke from the end delivery stroke during idling $h_{FEL}$ to the end delivery stroke at full load $h_{FEV}$ changes according to the position of the annular slide. It can be seen from this diagram that with increasing load, also during leakage, proceeding from the idling area, an increase of the injection quantity is effected via a residual feed at full feed rate subsequent to the feed hl at reduced feed rate. In this way, a load is subtained in an optimum manner. Moreover, in that the cross-sectional are of flow decreases due to the gradual closing of the radial duct 69, a continuous transition from the idling area with reduced injection rate to the partial and full-load areas with full injection rate also results in this instance. The construction has the advantage that the switching off device comprises fewer moved parts and is arranged in the interior of the fuel injection pump so as to be secured. For the purpose of adjustment, only the adjusting member need be adjusted externally, whereas the load-dependent switching off is effected automatically by means of the governor.

Figure 12:
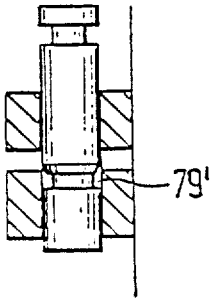

FIG. 12 shows a variant of the embodiment according to FIG. 8, in which one defining edge of the annular groove 79', which determines the closing process of the radial duct 69, is constructed so as to be conical. Accordingly, the transition behavior can be controlled in an improved manner. Also, the throttled flow, which was determined in the preceding embodiment examples by means of the throttle bore 54, can be controlled at this place. It is possible to exert influence as a function of operating parameters by means of the adjusting member 78. Instead of the annular groove, the slide pin can also be provided with a transverse duct in principle, wherein the rotational position of the slide pin must be secured in any case.

Figure 13:
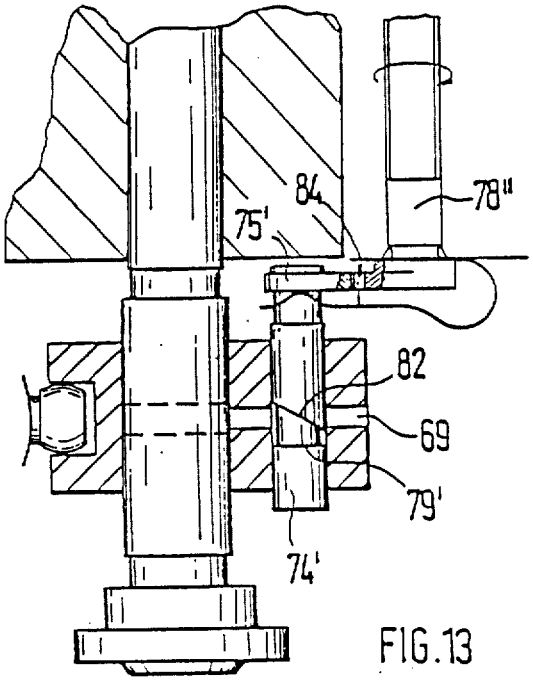

Moreover, adjustment possibilities result in a modified form by means of the embodiment example according to FIG. 13, where, instead of an annular groove with parallel defining edges at the slide pin 74', an annular recess is provided, whose one defining edge 81 lies in a radial plane relative to the axis of the slide pin and whose other controlling second defining edge 82 is inclined relative to the radial plane. Moreover, the slide pin 74' comprises a toothing 84 at its head 75', which teeth 84 engages with a corresponding engage with similar teeth of an adjusting member 78'' which, in this instance, is supported so as to be offset relative to the axis of the slide pin 74'. By means of rotating this adjusting member 78'', the slide pin 74 is rotated and the annular slide stroke, in which the radial duct 69 is closed, is changed. The head 75 of the slide pin 74' is held in contact with the pump housing by means of a coupling spring 76. An adjusting member, which is arranged so as to be offset relative to the axis of the slide pin, can also be used when a resilient element fastened at the pump housing is connected between the adjusting member and the head 74. In this case, as in the embodiment example according to FIG. 11, the adjusting member can be axially displaced for the purpose of adjustment. In principle, a switching off of the smooth-running device can also be effected with the aid of the adjusting member with corresponding actuating control, instead of a switching off by means of the adjustment of the annular slide by means of the fuel injection quantity governor.

Figure 11:
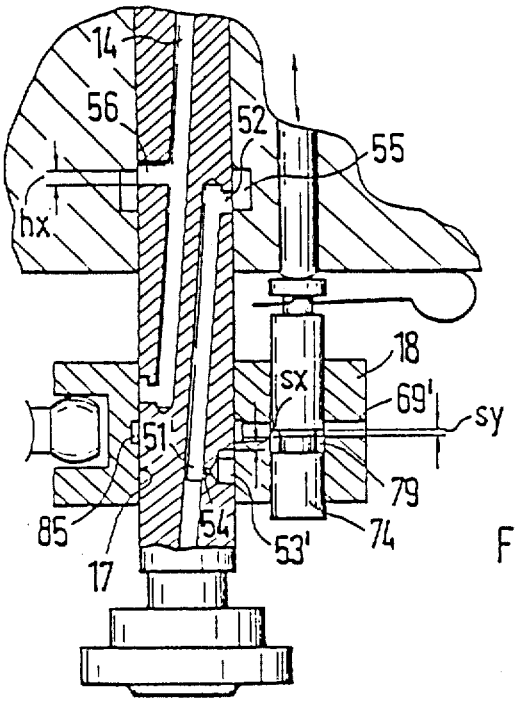
FIGS. 11, 12 and 13 are axial sections through three fifth, sixth, and seventh embodiments of this invention.

Finally, FIG. 11 shows a seventh embodiment which is constructed as a further development of the embodiment according to FIG. 8. In this embodiment, the second relief duct 51' constantly communicates with the annular groove 55 with its second outlet opening 52'. The second outlet opening 56 of the first relief duct 14, on the other hand, communicates with the annular groove 55 at the start of the pump plunger stroke, but is then closed after running through a stroke of magnitude hx. The initial stroke sv provided in the embodiment according to FIG. 8, by means of which the pump plunger delivers at full feed rate for pre-loading the volume on the high-pressure side, is realized in this instance at another place. Unlike the embodiment example according to FIGS. 2, 5 or 8, where the first outlet opening 53 of the second relief duct was already connected with the control opening 58 or 71, respectively, at the start of the stroke, the first outlet opening 53' of the second relief duct is, in this case, first closed by means of the outer surface area 17 of the annular slide 18 at the commencement of stroke. In addition, an annular groove 85 is provided as a control opening and is worked into the outer surface area 17 of the annular slide and connected with the suction space 7 and the relief space, respectively, by means of a radial duct 69' corresponding to the radial duct 69 of FIG. 8. The passage of the radial duct 69' is controlled in the same way as in the embodiment examples according to FIGS. 8, 12 or 13 by means of a slide pin 74 which comprises an annular groove 79, for example.

The control of this embodiment variant is effected in the following manner: after an initial stroke sx, the first outlet opening 53 communicates with the annular groove 85. After this point, fuel can flow off as leakage flow via a throttle 54' connected upstream of the first outlet opening 53 so long as the pump plunger stroke is smaller than hx or the end of delivery of the pump plunger $h_{FE}$, in which the first relief opening 16 is controlled by means of the control edge 19 of the annular slide, is not reached. As in the embodiment according to FIG. 8, the soft-running device is switched off by means of adjusting the annular slide 18 to a higher load, in that the one defining edge of the annular groove 79 closes the radial duct 69'. This is effected after an annular slide stroke sy, as can be seen from the diagram of FIG. 14. But when the annular slide 18 is adjusted to a higher load, the distance sx, after which the first outlet opening 53 communicates with the annular groove 85, also changes at the same time. In this way, when load is received subsequent to the stroke sv, which is required for pre-loading the fuel volume on the high-pressure side, a stroke with full feed rate is arranged prior to the latter until leakage can occur by means of the stroke hl. Since, in addition, the leakage distance hl following this is defined by means of the stroke hx, the leakage distance accordingly decreases as the load increases. After the closing of the second outlet opening 56, a smaller stroke of the pump plunger, again at full feed rate, can follow during a corresponding load until the geometric end of delivery $h_{FE}$ is achieved by means of controlling the first relief opening 16 of the first relief duct. The leakage when a load is received is controlled, in principle, by means of the adjustment of the annular slide via its adjustment area sy. In so doing, a smooth transition can also be achieved by means of throttling the radial duct 69'.

Figure 14:
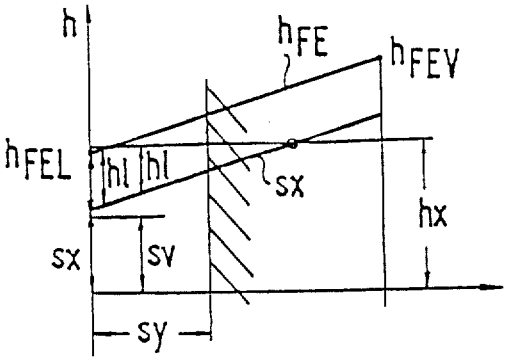
FIG. 14 is a graph illustrating operation of the system of FIG. 11.

A modified sequence of injection rates, which is desirable in particular cases, can be achieved with this arrangement during the soft running. It is advantageous for a soft running if, when a load is received from the idling position, only a small fuel quantity is first injected at full injection rate and penetration capacity in the combustion chamber, followed by an injection at reduced injection rate along a partial angle of the injection phase, which reduced injection rate allows for an ignition delay. In order to increase capacity when load is received, injection can be effected at full injection rate, in principle, after the ignition delay. In FIG. 14, the leakage distance, which lies between the coaxial lines hx and the upward sloping lines of the strokes sx, is designated by hl. By "external load-controlling means" in the following claims we mean a device which is not part of the fuel injection pump but is coupled or connected to it so that it can increase or decrease the fuel flow rate, e.g. the accelerator. The accelerator, for example, is mechanically coupled by adjusting lever 35 with the interrupting device 60.

We claim:

1. In a fuel-injection pump for an internal-combustion engine, the pump comprising:

a pump cylinder;

a pump plunger subdividing the cylinder into a pump working space and a relief space and formed with a first relief duct opening into the working space and also opening radially at a first outlet opening into the relief space;

means for periodically feeding fuel to the working space and for periodically rotating and axially reciprocating the plunger;

an annular slide displaceable in the relief space on the plunger over the first outlet opening; and means for axially shifting the annular slide to vary the venting of the working space to the relief space through the relief duct; the improvement comprising:

an annular groove formed in the cylinder and opening inward toward the plunger;

a second outlet opening of the first relief duct opening on the circumference of the plunger and being positionable at the annular groove;

a second relief duct in the plunger provided with a second outlet opening radially opening on the circumference of the plunger and also being positionable at the annular groove, the second outlet opening of the second relief duct being axially spaced relative to the second outlet opening of the first relief duct so that during a predetermined partial delivery stroke of the pump plunger said second outlet opening of said second relief duct communicates with said second outlet opening of said first relief duct via the annular groove;

a first outlet opening of the second relief duct which opens into the relief space in the vicinity of the annular slide;

a control opening in the annular slide, opening into the relief space, and alignable with the first outlet opening of the second duct; and an interrupting device connected mechanically with an external load-controlling means which in a first operating state connects the first outlet opening of the second relief duct with the relief space via the control opening according to the position of said external throttling means and in a second operating state disconnects the connection of the first outlet opening of the second relief duct with the relief space via the control opening according to said external throttling means.

2. In a fuel-injection pump for an internal-combustion engine, the pump comprising:

a pump cylinder;

a pump plunger subdividing the cylinder into a pump working space and a relief space and formed with a first relief duct opening into the working space and also opening radially at a first outlet opening into the relief space;

means for periodically feeding fuel to the working space and for periodically rotating and axially reciprocating the plunger;

an annular slide displaceable in the relief space on the plunger over the first outlet opening; and means for axially shifting the annular slide to vary the venting of the working space to the relief space through the relief duct;

the improvement comprising:

an annular groove formed in the cylinder and opening inward toward the plunger;

a second outlet opening of the first relief duct opening on the circumference of the plunger and being positionable at the annular groove;

a second relief duct in the plunger provided with a second outlet opening radially opening on the circumference of the plunger and also being positionable at the annular groove, the second outlet opening of the second relief duct being axially spaced relative to the second outlet opening of the first relief duct so that during a predetermined partial delivery stroke of the pump plunger said second outlet opening of said second relief duct communicates with said second outlet opening of said first relief duct via the annular groove;

a first outlet opening of the second relief duct which opens into the relief space in the vicinity of the annular slide;

a longitudinal groove in the annular slide, opening into the relief space on the pump drive side of the annular slide, and alignable with the first outlet opening of the second duct; and an interrupting device connected mechanically with an external load-controlling means which in a first operating state connects the first outlet opening of the second relief duct with the relief space via the longitudinal groove according to the position of said external throttling means and in a second operating state disconnects the connection of the first outlet opening of the second relief duct with the relief space via the longitudinal groove according to said external throttling means, said interrupting device comprising a rotating device of the annular slide which can bring said annular slide into a rotational position in which the first outlet opening of the second relief duct does not communicate with the longitudinal groove during the entire delivery stroke of pump plunger.

3. In a fuel-injection pump for an internal-combustion engine, the pump comprising:

a pump cylinder;

a pump plunger subdividing the cylinder into a pump working space and a relief space and formed with a first relief duct opening into the working space and also opening radially at a first outlet opening into the relief space;

means for periodically feeding fuel to the working space and for periodically rotating and axially reciprocating the plunger;

an annular slide displaceable in the relief space on the plunger over the first outlet opening; and means for axially shifting the annular slide to vary the venting of the working space to the relief space through the relief duct;

the improvement comprising:

an annular groove formed in the cylinder and opening inward toward the plunger;

a second outlet opening of the first relief duct opening on the circumference of the plunger and being positionable at the annular groove;

a second relief duct in the plunger provided with a second outlet opening radially opening on the circumference of the plunger and also being positionable at the annular groove, the second outlet opening of the second relief duct being axially spaced relative to the second outlet opening of the first relief duct so that during a predetermined partial delivery stroke of the pump plunger said second outlet opening of said second relief duct communicates with said second outlet opening of said first relief duct via the annular groove;

a first outlet opening of the second relief duct which opens into the relief space in the vicinity of the annular slide;

a radially-through-going duct in the annular slide, opening into the relief space, and alignable with the first outlet opening of the second duct; and an interrupting device connected mechanically with an external load-controlling means which in a first operating state connects the first outlet opening of the second relief duct with the relief space via the duct according to said external throttling means and in a second operating state disconnects the connection of the first outlet opening of the second relief duct with the relief space via the duct according to the position of said external throttling means, said interrupting means comprising a slide pin guided through a bore hole extending parallel to the axis of the pump plunger through the annular slide and intersecting said duct, said slide pin being provided with an annular groove adjacent said duct and being moveable by said external load controlling means.

4. Fuel injection pump according to claim 1, wherein the connection between the second outlet opening of the first relief duct and the second outlet opening of the second relief duct is interrupted via a partial stroke (sx, sv) of the pump plunger after the start of the pump plunger delivery stroke, and after the subsequent opening of this connection by means of the control edges of the annular groove, this connection is closed again after the partial stroke (hx).

5. Fuel injection pump according to claim 1, wherein the connection between the first outlet opening of the second relief duct and the control opening is interrupted via a partial stroke (sx) of the pump plunger after the start of the pump plunger stroke, during which partial stroke the connection between the second outlet opening of the first relief duct and the second outlet opening of the second relief duct is produced and maintained until the partial delivery stroke (hx).

6. Fuel injection pump according to claim 1, wherein a throttle is arranged in the connection between the connection of the first outlet opening of the second relief duct with the relief space and the connection of the second outlet opening with the first relief duct.

7. Fuel injection pump according to claim 1, wherein a throttle is arranged in the connection between the connection of the first outlet opening of the second relief duct with the relief space and the connection of the second outlet opening with the first relief duct.

8. Fuel injection pump according to claim 6, wherein the control opening is a longitudinal groove proceeding from the front side of the annular slide on the pump drive side.

9. Fuel injection pump according to one of claim 6, wherein the control opening is a connection opening of a duct leading through the annular slide to the relief space.

10. Fuel injection pump according to claim 8, wherein the interrupting device comprises a rotating device of the annular slide which can bring the latter into a rotational position in which the first outlet opening of the second relief duct does not communicate with the control opening during the entire delivery stroke of the pump plunger.

11. Fuel injection pump according to claim 9, wherein the interrupting device comprises a throttle member which is arranged in the duct in the annular slide and is interrupted by means of the load-dependent adjustment of the annular slide and/or by means of an adjusting element.

12. Fuel injection pump according to claim 11, wherein the throttle member is a slide pin which is guided in a bore hole extending parallel to the axis of the pump plunger through the annular slide and the duct which slide pin is provided with a transverse duct and/or annular groove forming the control edge and is coupled with an adjustable adjusting member.

13. Fuel injection pump according to claim 12, wherein the adjusting member is a resilient element which is fastened at the housing of the fuel injection pump and can be swiveled out by means of an actuating element, and a coupling spring is provided which engages at the slide pin and holds the slide pin at the adjusting member.

14. Fuel injection pump according to claim 12, wherein the adjusting member is an adjusting pin which is guided coaxially relative to the slide pin in the housing of the fuel injection pump, the slide pin being held at the adjusting pin by means of a coupling spring which is tensioned between the pump housing and the slide pin.

15. Fuel injection pump according to claim 12, wherein the adjusting member is a shaft which is guided in the housing of the fuel injection pump and coupled with the slide pin by means of a toothing.

16. Fuel injection pump according to claim 15, wherein the slide pin is rotatable by means of the shaft and comprises a diagonally extending control edge as control edge, which is the defining edges of an annular groove at the same time.

17. Fuel injection pump according to claim 12, wherein second outlet openings of the second relief duct are provided at the pump plunger corresponding to the number of delivery strokes effected per pump plunger revolution.

18. Fuel injection pump according to claim 10, wherein a single first outlet opening of the second relief duct is provided at the pump plunger and cooperates with control openings which are provided so as to be distributed at the annular slide corresponding to the number of delivery strokes effected per revolution of the pump plunger.

19. Fuel injection pump according to claim 10, wherein when there is an even number of delivery strokes per pump plunger revolution, the second relief duct comprises two diametrically opposed first outlet openings, a transverse bore hole, which intersects the second relief duct, opens into these first outlet openings, the latter cooperating alternately with control openings which are arranged so as to be distributed at the annular slide corresponding to the rotational angle spacing of the delivery strokes of the pump plunger, the number of the control openings amounts to a half of the pump plunger delivery strokes per revolution.

* * * * *